US010612505B2

(12) United States Patent
Hamann et al.

(10) Patent No.: US 10,612,505 B2
(45) Date of Patent: Apr. 7, 2020

(54) FUEL INJECTION VALVE WITH A WELD RING

(71) Applicant: Continental Automotive GmbH, Hannover (DE)

(72) Inventors: Christoph Hamann, Thalmassing (DE); Matteo Soriani, Leghorn (IT); Alessia Albano, Leghorn (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 15/767,480

(22) PCT Filed: Oct. 11, 2016

(86) PCT No.: PCT/EP2016/074364
§ 371 (c)(1),
(2) Date: Apr. 11, 2018

(87) PCT Pub. No.: WO2017/064074
PCT Pub. Date: Apr. 20, 2017

(65) Prior Publication Data

US 2019/0055909 A1 Feb. 21, 2019

(51) Int. Cl.
*F02M 51/06* (2006.01)
*F02M 61/16* (2006.01)
(Continued)

(52) U.S. Cl.
CPC .... *F02M 51/0614* (2013.01); *F02M 51/0671* (2013.01); *F02M 51/0685* (2013.01);
(Continued)

(58) Field of Classification Search
CPC ..... F02M 51/0614; F02M 51/0671; F02M 51/0685; F02M 61/08; F02M 61/168;
(Continued)

(56) References Cited

U.S. PATENT DOCUMENTS 6,679,435 B1 1/2004 Noller et al. ..... 239/5
6,695,233 B2 2/2004 Sekine et al. ..... 239/585.1
(Continued)

FOREIGN PATENT DOCUMENTS

CN 104411963 A 3/2015 ..... F02M 51/06
CN 104541049 A 4/2015 ..... F02M 51/06
(Continued)

OTHER PUBLICATIONS

Extended European Search Report, Application No. 15190013.1, 11 pages, dated Apr. 6, 2016.
(Continued)

*Primary Examiner* — Mahmoud Gimie
(74) *Attorney, Agent, or Firm* — Slayden Grubert Beard PLLC

(57) ABSTRACT

The present disclosure relates to internal combustion engines. Various embodiments thereof may include a fuel injection valve for a combustion engine comprising: a valve body with a cavity; a valve needle movable in the cavity; an actuator assembly to actuate the valve needle. The actuator assembly includes an electro-magnetic coil, a pole piece positioned inside the cavity, and an armature element. The armature element moves within the cavity to move the valve needle in a predetermined direction. A fixing ring abutting the pole piece, fixed to the valve body by means of joining to a circumferential surface of the cavity.

8 Claims, 3 Drawing Sheets

(51) Int. Cl.
*F02M 61/08* (2006.01)
*F02M 65/00* (2006.01)

(52) U.S. Cl.
CPC ..... *F02M 61/08* (2013.01); *F02M 61/168* (2013.01); *F02M 65/001* (2013.01); *F02M 2200/46* (2013.01); *F02M 2200/8061* (2013.01); *F02M 2200/8084* (2013.01); *F02M 2200/8092* (2013.01)

(58) Field of Classification Search
CPC ..... F02M 65/001; F02M 2200/46; F02M 2200/8061; F02M 2200/8084; F02M 2200/8092
USPC ..... 123/294
See application file for complete search history.

(56) References Cited

U.S. PATENT DOCUMENTS

| | | | | |
|---|---|---|---|---|
| 6,783,109 | B2 | 8/2004 | Ogura et al. | 251/129.15 |
| 9,528,610 | B2 | 12/2016 | Lenzi et al. | |
| 9,651,011 | B2 | 5/2017 | Romeo | |
| 2004/0003798 | A1 | 1/2004 | Mutschler | 123/470 |
| 2006/0278739 | A1 | 12/2006 | Nishiwaki et al. | 239/585.4 |
| 2008/0135020 | A1* | 6/2008 | Hornby | F02M 55/007 123/478 |
| 2008/0223346 | A1* | 9/2008 | Hornby | F02M 51/061 123/549 |
| 2009/0108107 | A1 | 4/2009 | Kitagawa et al. | 239/585.4 |
| 2009/0184184 | A1* | 7/2009 | Schwegler | F02M 51/0671 239/585.1 |
| 2015/0260138 | A1 | 9/2015 | Filippi et al. | 239/585.5 |
| 2016/0265499 | A1 | 9/2016 | Shingu et al. | 239/585.1 |

FOREIGN PATENT DOCUMENTS

| | | | | |
|---|---|---|---|---|
| JP | 5815758 | A | 1/1983 | |
| JP | 11294293 | A | 10/1999 | |
| JP | 2001082627 | A | 3/2001 | |
| JP | 2004353651 | A | 12/2004 | F02D 41/38 |
| JP | 2009228477 | A | 10/2009 | |
| JP | 2010185318 | A | 8/2010 | |
| KR | 20010052203 | A | 6/2001 | F02M 51/06 |
| KR | 20150048207 | A | 5/2015 | F02M 51/06 |
| WO | 2015/072031 | A1 | 3/1917 | |
| WO | 2017/064074 | A1 | 4/1917 | |
| WO | 2015/074927 | A1 | 5/2015 | |
| WO | WO 2015/072031 | A1 | 3/2017 | |

OTHER PUBLICATIONS

International Search Report and Written Opinion, Application No. PCT/EP2016/074364, 13 pages, dated Jan. 12, 2017.
Korean Office Action, Application No. 2019045687927, 16 pages, dated Jun. 26, 2019.
Chinese Office Action, Application No. 201680060301.0, 20 pages, dated Sep. 27, 2019.
Korean Notice of Allowance, Application No. 20187013651, 3 pages, dated Dec. 30, 2019.

* cited by examiner

FUEL INJECTION VALVE WITH A WELD RING

CROSS-REFERENCE TO RELATED APPLICATIONS

This application is a U.S. National Stage Application of International Application No. PCT/EP2016/074364 filed Oct. 11, 2016, which designates the United States of America, and claims priority to EP Application No. 15190013.1 filed Oct. 15, 2015, the contents of which are hereby incorporated by reference in their entirety.

TECHNICAL FIELD

The present disclosure relates to internal combustion engines. Various embodiments thereof may include a fuel injection valve and a fuel injection system. The fuel injection valve and system, respectively, may be used for delivering fuel to an internal combustion engine.

BACKGROUND

A fuel injection system admits a fuel, such as gasoline, into an internal combustion engine, which can be used for a vehicle, such as a car. Different types of fuel injection system may be divided generally into port fuel injection and direct injection. Port fuel injection delivers fuel into a runner of an air intake manifold that is connected to at least one intake port of an internal combustion engine. Direct injection delivers fuel directly into a combustion chamber of an internal combustion engine, typically during a compression stroke of the piston.

The direct injection allows greater control and precise release of fuel charge to the combustion chamber under various operating conditions. This then results in better fuel economy as well as in lower exhaust emissions. Moreover, the direct injection allows engines to have higher compression ratios, which enables delivery of higher engine performance with lower fuel consumption as compared to other fuel injection systems. High-pressure direct injection fuel injectors often use inwardly opening valves in conjunction with solenoid actuation.

SUMMARY

The teachings of the present disclosure may be embodied in an improved fuel injection valve. For example, a fuel injection valve (1) for a combustion engine may include: a valve body (12) that comprises a cavity (18) which hydraulically connects a fluid inlet portion (24) and a fluid outlet portion (27), a valve needle (14) being movable in the cavity (18) and configured for sealing and unsealing the fluid outlet portion (27), and an actuator assembly (5) being configured to actuate the valve needle (14). The actuator assembly (5) may comprise: an electro-magnetic coil (35), a pole piece (36) being positioned inside the cavity (18) of the valve body (12), and an armature element (33) being movable in the cavity (18) and operable to move the valve needle (14) in a predetermined direction for unsealing the fluid outlet portion (27). The fuel injection valve (1) further comprises a fixing ring that abuts the pole piece, the fixing ring (38) being fixed to the valve body (12) by means of joining to a circumferential surface of the cavity (18).

In some embodiments, the pole piece (36) is joined to the valve body (12) by press-fit.

In some embodiments, the fixing ring (38) and the armature element (33) are positioned on opposite sides of the pole piece (36) with respect to a longitudinal axis (L) of the valve body (12) so that the fixing ring (38) is operable to block displacement of the pole piece (36) in the predetermined direction.

In some embodiments, there is a retainer element (31) which is fixed to the valve needle (14), wherein the armature element (33) is operable to push the retainer element (31) for moving the valve needle (14) in the predetermined direction.

In some embodiments, the fixing ring (38) is fixed to the valve body (12) by press fit and/or by a welded connection (41) and/or by a brazed connection.

In some embodiments, the fixing ring (38) is fixed to the pole piece (36) by press fit.

In some embodiments, the fixing ring (38) is joined to at least two portions of the valve body (12).

In some embodiments, there is a spring element (39) next to the valve needle (14), wherein the spring element (39) is provided to push the valve needle (14) towards the fluid outlet portion (27).

As another example, a combustion engine may comprise: at least one fuel injection valve (1) according to the description above and at least one combustion chamber for receiving fuel from the corresponding fuel injection valve (1).

As another example, a vehicle may comprise: a plurality of wheels or propellers and a combustion engine according to the description above for driving the wheels or propellers, respectively.

As another example, a method for producing a fuel injection valve (1) for a combustion engine may comprise: shifting a pole piece (36) into a cavity (18) of a valve body (12) having a longitudinal axis (L), adjusting an axial position of the pole piece (36) with respect to the valve body (12), and inserting a fixing ring (38) into the cavity (18) so that the fixing ring (38) abuts the pole piece (36), and fixing the fixing ring (38) to a circumferential surface of the cavity (18) of the valve body (12).

Some embodiments may include inserting a valve needle (14) and an armature (33), which is mechanically coupled to the valve needle (14), into the cavity (18) so that the valve needle (14) seals a fluid outlet portion (27) of the valve body (12), moving the armature (33) for displacing the valve needle (14) in a predetermined direction away from the fluid outlet portion (27) to dispense fluid from the fluid outlet portion (27) after inserting the valve needle (14) and the armature (33) into the cavity (18) and shifting the pole piece (36) into the cavity, and measuring the amount of the dispensed fluid, wherein the adjustment of the axial position of the pole piece (36) with respect to the valve body (12) is carried out in dependence of the measured amount of the dispensed fluid, and inserting the fixing ring (38) into the cavity (18) such that it abuts a side of the pole piece (36) opposite of the armature (33).

In some embodiments, the fixing ring (38) is fixed to the valve body (12) by press fit and/or by welding and/or by brazing.

As another example, a method of operating a fuel injection valve (1) for a combustion engine may comprise: a valve opening step and a valve closing step. The valve opening step comprises an electro-magnetic coil (35) providing a magnetic field, a pole piece (36) gathering and directing the magnetic field to an armature element (33), and the armature element (33) pushing a retainer element (31) such that a valve needle (14) allows a fluid to flow through a fluid outlet portion (27) of a valve body (12). The valve closing step comprises a spring element (39) pushing the valve needle (14) such that the valve needle (14) prevents the fluid from flowing through the fluid outlet portion (27). During the valve opening step and during the valve closing step, a fixing ring (38) abuts a pole piece (36) and secures the pole piece (36) to a circumferential surface of a cavity (18) of the valve body (14), the cavity hydraulically connecting a fluid inlet portion (24) to the fluid outlet portion (27).

BRIEF DESCRIPTION OF THE DRAWINGS

Various embodiments and developments of the fuel injection valve and of the methods for producing and operating the same will become apparent from the embodiments described below in association with the figures. In the figures.

Figure 1:
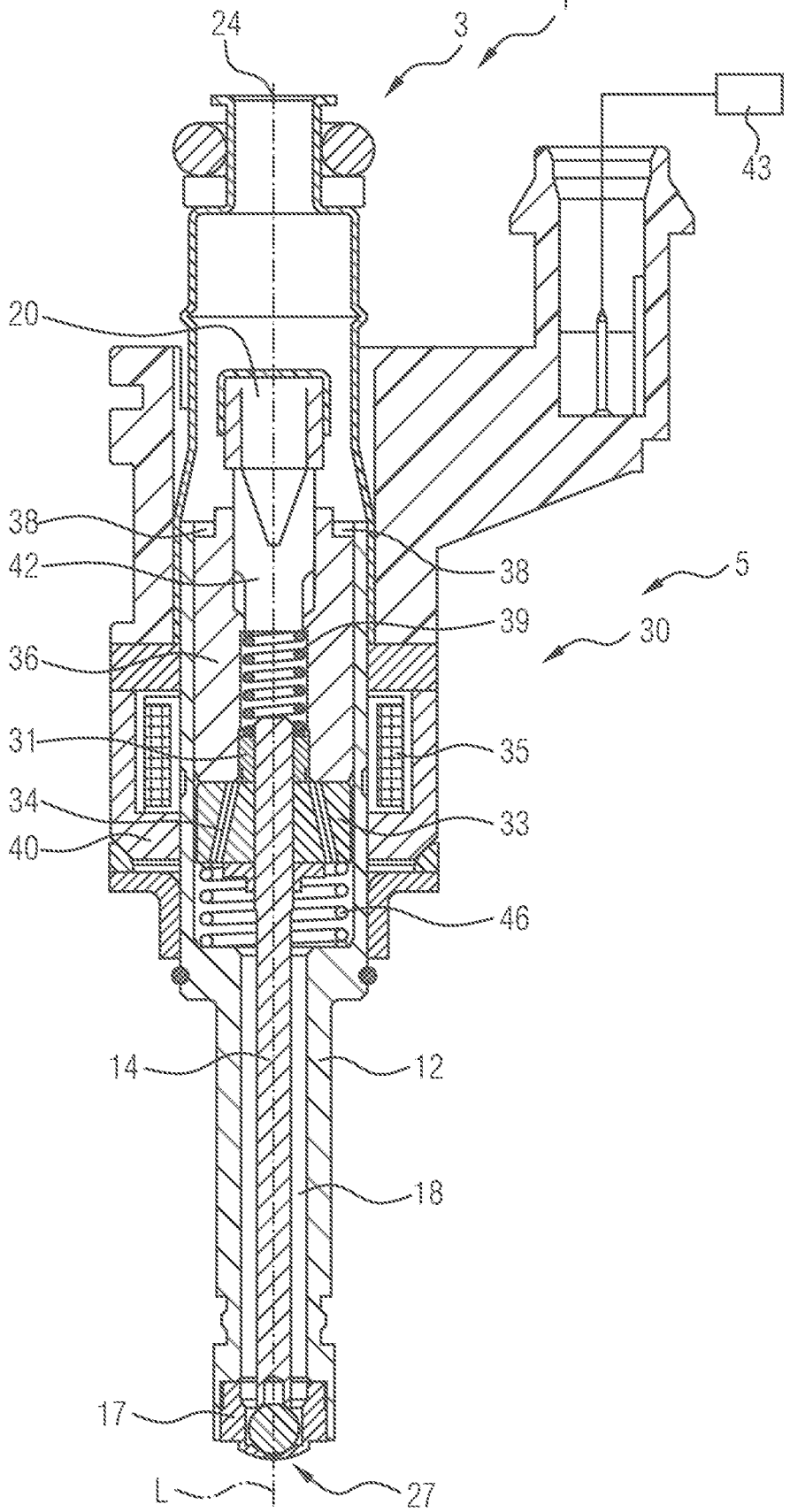
FIG. 1 illustrates a schematic view of an injection valve according to the teachings of the present disclosure.

In the following description, details are provided to describe embodiments of the application. It shall be apparent to one skilled in the art, however, that the embodiments may be practiced without such details. Some parts of the embodiments have similar parts. The similar parts may have the same names or similar part numbers with an alphabet symbol. The description of one similar part also applies by reference to another similar part, where appropriate, thereby reducing repetition of text without limiting the disclosure.

DETAILED DESCRIPTION

Some embodiments may include a fuel injection valve for a combustion engine, an internal combustion engine. Some embodiments may include an internal combustion engine with the fuel injection valve and a vehicle with the combustion engine. Some embodiments may include methods for producing and operating the fuel injection valve. Features which are disclosed in the following in connection with one of the aspects are also useful for the other aspects.

In some embodiments, the fuel injection valve may be actuated by a solenoid for regulating flow of fuel, such as gasoline, to the combustion engine. The injection valve is also called an injector. The combustion engine burns the fuel for generating mechanical power. In some embodiments, the fuel injection valve includes an element for preventing its pole piece from moving when the injector is in use.

The fuel injection valve includes a valve body, a moveable valve needle, and an actuator assembly. The valve needle is placed inside the valve body. The actuator assembly serves to move the valve needle for regulating the flow of fuel through the valve body. The valve body includes an elongated cavity with a fluid inlet portion and a fluid outlet portion. The cavity may connect the fluid inlet portion and the fluid outlet portion hydraulically. The valve body is elongated along a longitudinal axis. The cavity extends axially from the fluid inlet portion to the fluid outlet portion. The fluid inlet portion is configured for receiving fuel from a fuel rail while the fluid outlet portion acts to release the received fuel to a combustion chamber of the combustion engine.

The valve needle is placed in the cavity of the valve body and it can move axially with respect to the valve body. In some embodiments, the valve needle is axially displaceable in the cavity relative to the valve body in reciprocating fashion. The valve needle is configured for sealing and unsealing the fluid outlet portion of the valve body. In some embodiments, the valve needle sealingly rests on a valve seat of the valve body in a closing position to prevent fluid flow through the fluid outlet portion and is axially displaceable away from the closing position, i.e. to establish a gap between the valve needle and the valve seat, for enabling fluid flow through the fluid outlet portion.

The actuator assembly is configured to actuate the valve needle such that the valve needle can move—in an axial direction—with respect to the valve body, for closing or opening the fluid outlet portion of the fuel injection valve. The actuator assembly includes an electro-magnetic coil, a pole piece, and an armature element. The pole piece and the armature element are placed inside the cavity while the electro-magnetic coil surrounds the valve body.

The electro-magnetic coil may generate a magnetic field when the electro-magnetic coil is energized by electrical energy from an external electrical source. The pole piece may gather the magnetic field from the electro-magnetic coil and direct the gathered magnetic field to the armature element. In other words, the pole piece is a portion of the magnetic circuit of the actuator assembly and represents a stationary core of the actuator assembly.

The armature element is movable axially with respect to the valve body in the cavity. In other words, the armature element is axially displaceable in reciprocating fashion relative to the valve body and the pole piece. The armature element represents a moveable core of the actuator assembly. The armature element interacts with the magnetic field from the pole piece, wherein the interaction acts to move the armature element. Specifically, the armature element is attracted towards the pole piece when the coil is energized.

The armature element moves the valve needle in a predetermined direction, in particular for unsealing the fluid outlet portion. In some embodiments, the armature element mechanically interacts with the valve needle for moving the valve needle away from the closing position. In some embodiments, the armature element is fixed to the valve needle or operable to engage in a form-fit connection with the valve needle so that it takes the valve needle with it when it moves towards the pole piece.

In some embodiments, the fuel injection valve comprises a retainer element. The retainer element is fixed to a portion—e.g. a shaft—of the valve needle. The armature is operable to engage in form-fit connection with the retainer element. The armature element may push the retainer element and the valve needle together in the predetermined direction. The predetermined direction is the axial direction directed from the armature towards the pole piece. In case of an inward opening valve—i.e. the valve needle is moved in direction from the fluid outlet portion towards the fluid inlet portion for unsealing the fluid outlet portion—the predetermined direction is directed axially from the fluid outlet portion towards the pole piece.

In some embodiments, the pole piece may stop movement of the armature element and/or of the valve needle in the predetermined direction, i.e. in particular in axial direction towards the pole piece.

In some embodiments, the actuator assembly comprises a spring element. The spring element is provided next to the valve needle inside the cavity. In some embodiments, the spring element is seated against the valve needle or against the retainer element and against the valve body or a part which is positionally fixed relative to the valve body on opposite axial ends so that it is pre-compressed. The spring element is adapted for urging the valve needle to a predetermined position. In some embodiments, the pre-compressed spring element biases the valve needle towards the closing position. The spring element may expediently be provided for moving the valve needle in a direction opposite to the predetermined direction for sealing the fluid outlet portion. Examples of the spring element include a coil spring, a spiral spring, a magnetic spring, and a gas spring.

In some embodiments, the fuel injection valve provides a closed position and an open position. In the closed position, the spring element acts to move the valve needle to the closing position for closing the fluid outlet portion, thereby preventing a fluid from flowing through the fluid outlet portion. In the open position, the armature element acts to retain the valve needle in a predetermined opening position for allowing the fluid to flow through the fluid outlet portion into the combustion engine. In particular, the armature and/or the valve needle abut the pole piece when the fuel injection valve is in the open position.

In some embodiments, the fuel injection valve further comprises a fixing ring that abuts the pole piece. The fixing ring is fixed or is joined to the valve body. In some embodiments, the fixing ring and the armature element are positioned on opposite sides of the pole piece with respect to the longitudinal axis. In this way, the fixing ring is operable to block displacement of the pole piece in the predetermined direction.

The fixing ring allows a consistent and precise lifting of the valve needle from the fluid outlet portion. During operation of the injection valve, the pole piece can experience forces that act to shift or move the pole piece. The armature element and/or the valve needle can hit the pole piece with a force for shifting the pole piece in the predetermined direction. In the case of a high fuel pressure, often greater than 350 bars, the forces transferred to the pole piece when it is hit by the armature element or the valve needle at the end of the opening transient when the valve reaches the open position can be so large that there is a risk in conventional valves that the connection between the pole piece and the valve body cannot sufficiently counter these forces. The pole piece may then shift relative to the valve body. If the pole piece is shifted, this, in turn, can affect the movement of the armature element and the movement of the valve needle, thus influencing the injection characteristics of the valve. The fixing ring acts to prevent the pole piece from moving. The valve needle can then have a consistent and precise lift. The securing of the pole piece by the fixing ring also may not require a change of the outer shape of the pole piece. In other words, the design of the pole piece does not need to be changed in order for the fixing ring to abut the pole piece.

In a general sense, the fixing ring can have a shape of circular band or have a shape of a partial circular band. The fixing ring may be fixed to the valve body by press fit for keeping the fixing ring from moving. The press fit refers to a fastening between two parts, wherein the parts are pushed together and frictional forces keeps the parts together. In effect, the fixing ring acts to prevent the pole piece from moving. The fixing ring can also be fixed to the pole piece by press fit, e.g. for keeping the fixing ring from moving.

In some embodiments, the fixing ring is joined to the valve body by welding for providing a strong mechanical bond between the fixing ring and the valve body. During welding, two or more metal portions are joined, wherein the metal portions are in a liquid state. In some embodiments, the welding includes a filler material being provided for joining the fixing ring to the valve body. In some embodiments, the materials of the fixing ring and the valve body are selected such that the welding can be done without the filler material. The welding allows a material that is suitable for welding to be selected for the fixing ring while a material that has high magnetic permeability to be selected for the pole piece. Put differently, this configuration does not restrict the choice of material for the pole piece while at the same time preventing the pole piece from being moved when it is hit by the armature element or the valve needle. This is different from a welding of the pole piece to the valve body, wherein a material for the pole piece is selected for meeting both objectives, namely high magnetic permeability and being suitable for welding. Such a material often cannot fully fulfill both objectives.

In some embodiments, the fixing ring is joined to the valve body by brazing. During brazing, a filler material is used for joining two or more metal portions, wherein the metal portions are in a solid state while the filler material is in a liquid state. The fixing ring may be joined to an inner part of the valve body, i.e. in particular to a circumferential surface of the cavity. This joining provides no risk or little risk of cracking of the valve body. This joining also enables better control of weld quality as compared with overlap welding for joining the fixing ring to an outer part of the valve body.

In some embodiments, the fixing ring can also be joined to two or more portions of the valve body. The joined portions can be an arc shape. The portions can also be spaced apart from one another axially or circumferentially to provide for a stable joint between the fixing ring and the valve body.

In some embodiments, the pole piece can attached to the valve body—in particular to the circumferential surface of the cavity—by press fit. The press fit enables an accurate positioning of the pole piece with respect to the valve body, while the position of the pole piece remains adjustable during manufacturing of the fuel injection valve.

The spring element can push the valve needle towards the fluid outlet portion for closing the fluid outlet portion. The spring element can include a coil.

The combustion engine may include one or more of the above-mentioned fuel injection valves and one or more corresponding combustion chambers. Typically, each injection valve provides fuel to a respective combustion chamber. The vehicle may be provided with a plurality of wheels and with the above-mentioned combustion engine for driving the wheels in one embodiment. Examples of this vehicle are a truck and a car. In some embodiments, the vehicle is provided with a plurality of propellers and with the above-mentioned combustion engine for rotating the propellers. One example of this vehicle is a boat.

The method for producing a fuel injection valve for a combustion engine may include a step of shifting a pole piece—at least partially—into a cavity of a valve body which has a longitudinal axis. The method may further include a step of adjusting the axial position of the pole piece with respect to the valve body. A fixing ring is also inserted into the cavity so that the fixing ring abuts the pole piece. In one method step, the fixing ring is secured or is fixed to the valve body.

In some embodiments, the method comprises inserting the valve needle and the armature—the armature being mechanically coupled to the valve needle—into the cavity so that the valve needle seals a fluid outlet portion of the valve body. In a further method step, after inserting the valve needle and the armature into the cavity and shifting the pole piece into the cavity, the armature is moved—in particular by generating a magnetic field with an electromagnetic coil which extends circumferentially around the valve body—for displacing the valve needle in a predetermined direction away from the fluid outlet portion to dispense fluid from the fluid outlet portion. The coil can be the coil of the actuator of the fluid injection valve or a dedicated coil of a test stand.

The amount of the dispensed fluid is expediently measured. The adjustment of the axial position of the pole piece with respect to the valve body may be carried out in dependence of the measured amount of the dispensed fluid. Expediently, the fixing ring may be inserted into the cavity such that it abuts a side of the pole piece opposite of the armature.

In some embodiments, the fixing ring is fixed to the valve body by press fit. The method can additionally or alternatively include a step of securing the fixing ring to the valve body by welding. Alternatively or additionally, the method can include a step of securing the fixing ring to the valve body by brazing.

The method of operating a fuel injection valve for a combustion engine includes a valve-opening step and a valve-closing step. Referring to the valve-opening step, it includes a step of an electro-magnetic coil providing a magnetic field. A pole piece then gathers and directs the magnetic field to an armature element. The armature element later pushes a retainer element such that a valve needle allows a fluid, such as fuel, to flow through a fluid outlet portion of a valve body. Referring to the valve-closing step, it includes a spring element pushing the valve needle such that the valve needle prevents the fluid from flowing through the fluid outlet portion.

During the valve-opening step and during the valve-closing step, a fixing ring abuts a pole piece and secures the pole piece to the valve body. In effect, the fixing ring prevents the pole piece from moving during operation of the fuel injection valve. This then allows consistency of lifting of the valve needle.

FIG. 1 shows an exemplary embodiment of a fuel injection valve 1 according to the teachings of the present disclosure. The fuel injection valve 1 includes a valve assembly 3 and an electromagnetic actuator assembly 5. The valve assembly 3 is connected to the electromagnetic actuator assembly 5.

Referring to the valve assembly 3, it includes an elongated valve body 12 with a valve seat 17, a movable solid valve needle 14. The valve seat 17 is fixedly connected to a one-piece main part of the valve body 12. The valve needle 14 is placed inside the valve body 12. One end of the valve needle 14 can touch a sealing surface of the valve seat 17. The expression "one-piece" means in the present context that the main part is not assembled from a plurality of parts which are connected to one another during the manufacturing process of the main part. Rather, the main part of the valve body is a single workpiece or made from a single workpiece. In some embodiments, the main part comprises a metal tube.

The valve body 12 includes a fluid inlet portion 24, a fluid outlet portion 27, and an elongated cavity 18. The fluid outlet portion is also called an injection opening. A fluid filter 20 is positioned adjacent to the fluid inlet portion 24.

The elongated cavity 18 is formed inside the elongated valve body 12, wherein the cavity 18 extends from one end of the valve body to another end of the valve body 12 with respect to a longitudinal axis L of the valve body 12. The fluid inlet portion 24 is at a first end of the cavity 18 and comprises an inlet tube shifted over the main part of the valve body 12 so that an end region of the inlet tube remote from the fluid inlet portion 24 extends circumferentially around and axially overlaps with the main part. The fluid inlet portion 24 comprises an opening that is adapted for connecting with a fuel rail via a pipe. The fuel rail and the pipe are not shown in FIG. 1.

The fluid outlet portion 27 is integrally connected to a second end of the cavity 18. The fluid outlet portion 27 comprises the opening of the valve seat 17, which is adapted for attaching to a combustion chamber of an engine cylinder. The combustion chamber is not shown in FIG. 1.

The valve needle 14 is placed inside the cavity 18 and it can move axially with respect to the valve body 12. The valve needle 14 has an elongated solid body, i.e. a shaft. An end of the valve needle 14 is a valve ball, which can contact with the valve seat 17. The valve ball is positioned at one axial end of the shaft. In an axial end region of the shaft which is remote from the valve ball, a retainer element 31 is fixed to the shaft so that it projects radially from the shaft and extends circumferentially around the shaft.

Referring to the electromagnetic actuator assembly 5, it includes an electro-magnetic coil 35, a yoke 40, a stationary pole piece 36, a movable armature element 33, an armature return spring 46, a main spring 39, and a calibration tube 42.

The pole piece 36, the armature element 33, the armature return spring 46, the main spring 39, and the calibration tube 42 are placed inside the cavity 18. The armature element 33 is axially positioned between the armature return spring 46 and the retainer element 31. The electro-magnetic coil 35 and the yoke 40 surround the valve body 12. The yoke 40 is fixed to the valve body 12.

The fuel injection valve 1 further comprises a fixing ring which may comprise a weld ring 38. The weld ring 38 is placed next to the pole piece 36. The pole piece 36 is positioned in the vicinity of the armature element 33 so that the armature is attracted towards the pole piece 36 when the actuator assembly 5 is operated by energizing the coil 35 and so that the pole piece 36 is operable to stop displacement of the armature element 33 towards the pole piece 36 by means of a form-fit engagement. The armature 33 is placed in the vicinity of the retainer element 31 so that it is operable to engage in form-fit connection with the retainer element 31 for moving the valve needle 14 away from the fluid outlet portion 27. The weld ring 38 and the armature element 33 are arranged on opposite axial sides of the pole piece 36.

Figure 2:
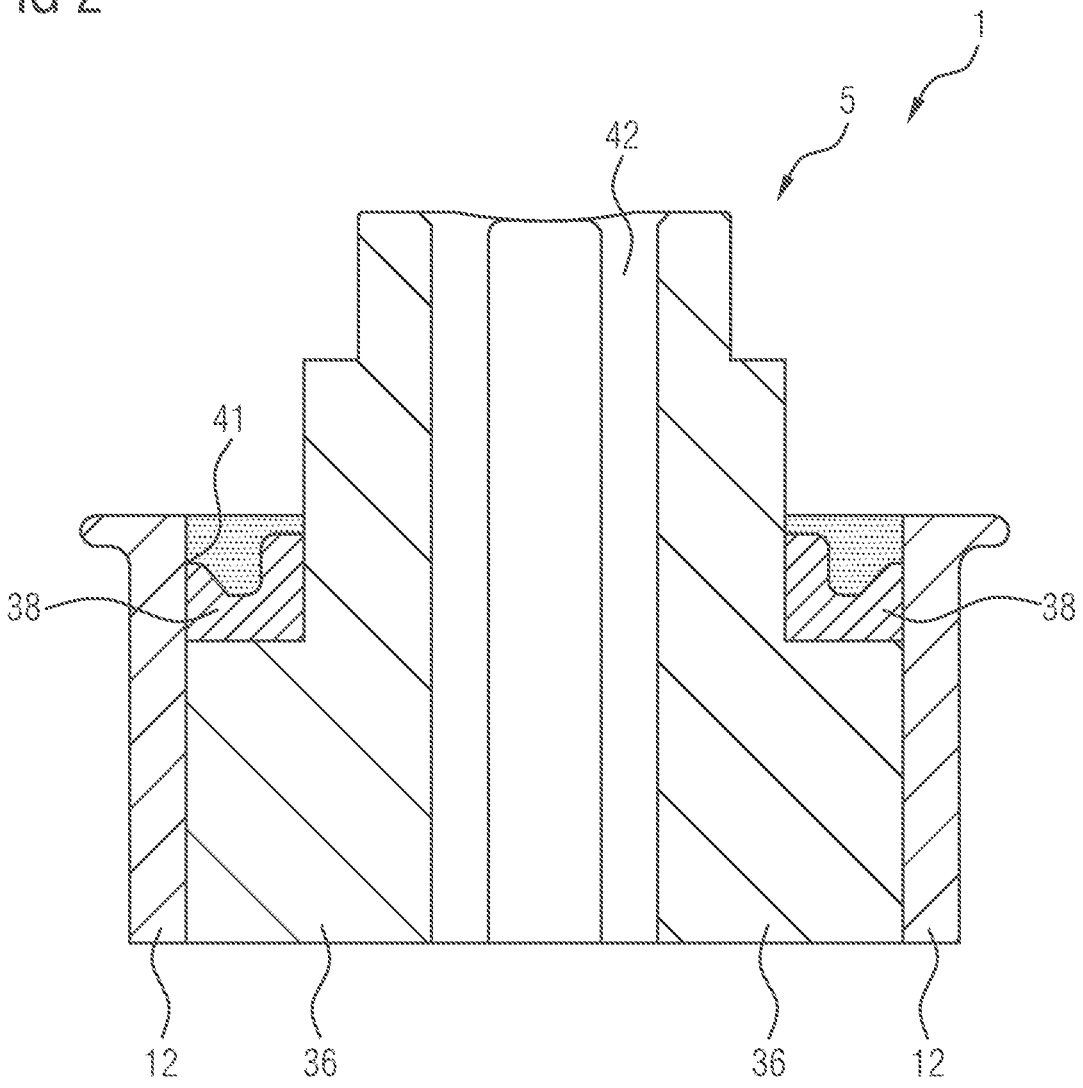
FIG. 2 illustrates an expanded side view of a section of the improved injection valve of FIG. 1.
Figure 3:
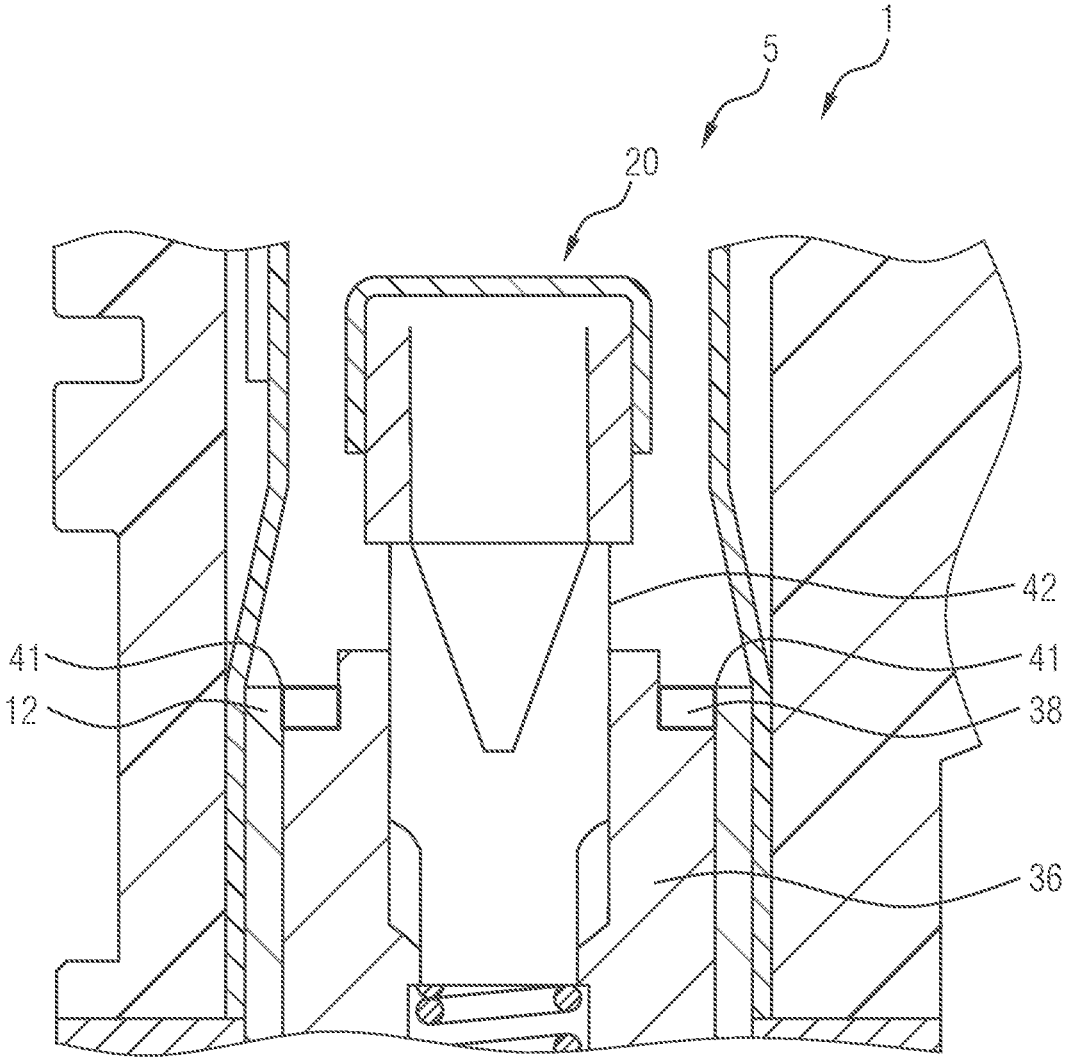
FIG. 3 illustrates an expanded sectional view of a section of the injection valve of FIG. 1.

In detail, the pole piece 36 is inserted inside the main part of the valve body 12 and it is placed at a predetermined location in the valve body 12. The pole piece 36 may be fastened to the main part of the valve body 12 by press fit. As better seen in FIGS. 2 and 3, the weld ring 38 is placed next to the pole piece 36 and it abuts the pole piece 36. It may also be fastened to the pole piece 36 by press fit. Moreover, the weld ring 38 is joined to an inner surface of the main part of the valve body 12 by a welded joint 41. In this way, the frictional force of the press-fit connection between the pole piece 36 and the main part of the valve body 12 and the form-fit and press-fit connection of the pole piece 36 with the weld ring 38—which is positionally fix relative to the valve body 12 due to its welded connection with the main part—cooperate to prevent the pole piece 36 from moving with respect to the valve body 12 in axial direction towards the fluid inlet portion 24.

The weld ring 38 comprises a material that is suitable for welding while the pole piece 36 comprises a material that has high magnetic permeability that serves to direct the magnetic field produced by a magnet. In particular, the weld ring 38 and the pole piece 36 are made from stainless steel having different steel grades.

The welded joint 41 may be formed using laser welding technique. A continuous or pulsed laser beam may also be used to form the welded joint 41. The welded joint 41 can include two small arc portions, which are spaced apart for providing a stable connection with the valve body 12. The arc portion is also called spots. In a general sense, the welded joint 41 can include more than one arc portions, such as three or four portions.

The armature element 33 may include a cylindrical body with a central axial opening. The cylindrical body has one or more through holes 34. The through holes 34 extend from a first axial side of the cylindrical body to the opposite axial side of the cylindrical body.

The retainer element 31 may comprise a collar around the shaft of the valve needle 14. In particular, the retainer element 31 is fixedly coupled to an end portion of the outer surface of the shaft.

One end of the main spring 39 is placed next to the retainer element 31 and another end of the main spring 39 is blocked by a supporting part which supporting part is in the present case the calibration tube 42. The calibration tube may be press-fit into a central opening of the pole piece 36 so that it is axially displaceable during manufacturing of the fuel injection valve 1 for setting a preload of the main spring 39. The main spring 39 may be seated on the retainer element 39 so that it exerts a force on the retainer element 31 that is directed towards the fluid outlet portion 27. In use, the calibration tube 42 acts to preload the main spring 39. In other words, the calibration tube 42 compresses the main spring 39.

The electro-magnetic coil 35 may be electrically connected to an Engine Control Unit (ECU) 43. The electro-magnetic coil 35 is adapted for magnetically coupling to the armature 33.

The valve needle 14 may be inserted inside the armature 33—i.e. it extends through the central axial opening—and is circumferentially surrounded by the armature return spring 46.

The ECU 43 is intended for providing electrical energy, in the form of an electrical current, to the electro-magnetic coil 35. When the electro-magnetic coil 35 receives the electrical current, it generates a corresponding electro-magnetic field. The yoke 40 gathers and shapes the electro-magnetic field from the electro-magnetic coil 35 and it directs the electro-magnetic field to the pole piece 36 and/or the armature element 33. The pole piece 36 serves to gather and concentrate the magnetic field, e.g. from the yoke 40. The pole piece 36 also acts to direct the magnetic field to the armature 33. The armature 33 receives the magnetic field from the pole piece 36, wherein the magnetic field interacts with the armature 33 for pulling the armature 33 away from the fluid outlet portion 27.

The armature 33 then moves away from the fluid outlet portion 27. It also pushes the retainer element 31 away from the fluid outlet portion 27. This pushing is directed to oppose the force of the main spring 39, which is directed towards the fluid outlet portion 27.

The armature return spring 46 biases the armature 33 in an axial direction away from the fluid outlet portion 27, in contact with the retainer element 31. The fuel injection valve 1 with the weld ring 38 can also have actuator configurations without such an armature return spring 46 or with an armature return spring 46 that biases the armature element 33 away from the retainer element 31 to enable a free lift of the armature element 33.

The valve needle 14 selectively contacts the valve seat 17 for opening and closing the fluid outlet portion 27. The fluid inlet portion 24 is intended to receive fuel from a fuel rail via the fluid filter 20. The fluid outlet portion 27 allows the fuel from the cavity 18 to flow to a combustion chamber of an engine cylinder.

The weld ring 38 serves to fix the position of the pole piece 36 with respect to the valve body 12. This is done to prevent the pole piece 36 from shifting during operation of the injection valve 1. The armature 33 can hit the pole piece 36 with a force that acts to shift the pole piece 36. This force can be great especially when the fuel pressure inside the valve body 12 is large.

The injection valve 1 provides an open position and a closed position. The weld ring 38 serves to keep the pole piece 36 from shifting when the injection valve 1 operating between the open position and the closed position. In the open position, the main spring 39 exerts a force on the retainer element 31 that is directed towards the fluid outlet portion 27 while the ECU 43 energizes the electro-magnetic coil 35. The electro-magnetic coil later generates a corresponding electro-magnetic field. The yoke 40 afterward directs the electro-magnetic field to the pole piece 36. The pole piece 36 then gathers and concentrates the electro-magnetic field and it directs the electro-magnetic field to the armature 33. The armature 33 later receives the electro-magnetic field, wherein the electro-magnetic field interacts with the armature 33 to force the armature 33 to displace away from the fluid outlet portion 27. The armature 33 afterward moves away from the fluid outlet portion 27 and it also pushes the armature retainer 31 away from the fluid outlet portion 27.

The valve needle 14 is then separated from the fluid outlet portion 27 of the fuel injection valve 1. This allows fuel to flow from the fuel rail, to the fluid inlet portion 24, to the cavity 18, to the through holes 34 of the armature 33, to the fluid outlet portion 27, and to the combustion chamber of the engine cylinder.

In the closed position, the main spring 39 exerts a force on the retainer element 31 that is directed towards the fluid outlet portion 27 while the ECU 43 does not provide electrical energy to the electro-magnetic coil 35. When the coil 35 is de-energized, the armature 33 stops exerting a force on the retainer element 31 that opposes the force of the main spring 39. The main spring 39 then pushes the armature retainer 31 together with the valve needle 14 towards the fluid outlet portion 27, wherein the valve needle 14 contacts with the fluid outlet portion 27 and closes the fluid outlet portion 27.

The weld ring 38 may act as a pole piece retention mechanism that fixes the pole piece 36 with respect to the valve body 12 reliably such that the pole piece 36 does not shift during operation of the fuel injection valve 1 even in a high-pressure fluid environment. This then ensures consistency in lifting of the valve needle, thereby allowing fuel to be injected with a desired amount into the combustion chamber reliably and consistently.

The joining of the weld ring 38 to the inside of the valve body 12 reduces risk of cracks of the valve body 12. This joining also acts to improve weld quality as compared with overlap welding for joining the weld ring 38 to an outer part of the valve body 12. The shape of pole piece 36 also does not need to be changed for accommodating the weld ring 38. The material of the weld ring 38 can be different from the material of the pole piece 36 and can be selected according to their functions without any restriction.

Although the above description contains much specificity, this should not be construed as limiting the scope of the embodiments but merely providing illustration of the foreseeable embodiments. The above stated advantages of the embodiments should not be construed especially as limiting the scope of the embodiments but merely to explain possible achievements if the described embodiments are put into practice. Thus, the scope of the embodiments should be determined by the claims and their equivalents, rather than by the examples given.

What is claimed is:

1. A fuel injection valve for a combustion engine, the fuel injection valve comprising:

a valve body with a cavity hydraulically connecting a fluid inlet portion and a fluid outlet portion;

a valve needle movable in the cavity to seal and unseal the fluid outlet portion;

an actuator assembly to actuate the valve needle;

the actuator assembly includes an electro-magnetic coil, a pole piece positioned inside the cavity, and an armature element mechanically coupled to the valve needle;

the armature element moves within the cavity to move the valve needle in a predetermined direction for unsealing the fluid outlet portion; and a fixing ring abutting the pole piece opposite the armature element and fixed to the pole piece by a press-fit;

the fixing ring fixed to the valve body by brazing and/or welding the fixing ring to a circumferential surface of the cavity forming at least one arc portion of a welded joint between the fixing ring and the valve body.

2. The fuel injection valve according to claim 1, further comprising a retainer element fixed to the valve needle;

wherein the armature element pushes the retainer element to move the valve needle in the predetermined direction.

3. The fuel injection valve according to claim 1, further comprising the fixing ring joined to at least two portions of the valve body.

4. The fuel injection valve according to claim 1, further comprising a spring element arranged next to the valve needle;

wherein the spring element pushes the valve needle towards the fluid outlet portion.

5. A combustion engine comprising:

a combustion chamber for receiving fuel;

a valve body with a cavity hydraulically connecting a fluid inlet portion and a fluid outlet portion connected to the combustion chamber;

a valve needle movable in the cavity to seal and unseal the fluid outlet portion;

an actuator assembly to actuate the valve needle;

the actuator assembly includes an electro-magnetic coil, a pole piece positioned inside the cavity, and an armature element mechanically coupled to the valve needle;

the armature element moves within the cavity to move the valve needle in a predetermined direction for unsealing the fluid outlet portion; and a fixing ring abutting the pole piece opposite the armature element and fixed to the pole piece by a press-fit;

the fixing ring fixed to the valve body by brazing and/or welding the fixing ring to a circumferential surface of the cavity forming at least one arc portion of a welded joint between the fixing ring and the valve body.

6. A vehicle comprising:

a plurality of wheels or propellers; and a combustion chamber for driving the plurality of wheels or propellers by burning fuel;

a valve body with a cavity hydraulically connecting a fluid inlet portion and a fluid outlet portion connected to the combustion chamber;

a valve needle movable in the cavity to seal and unseal the fluid outlet portion;

an actuator assembly to actuate the valve needle;

the actuator assembly includes an electro-magnetic coil, a pole piece positioned inside the cavity, and an armature element mechanically coupled to the valve needle;

the armature element moves within the cavity to move the valve needle in a predetermined direction for unsealing the fluid outlet portion; and a fixing ring abutting the pole piece opposite the armature element and fixed to the pole piece by a press-fit;

the fixing ring fixed to the valve body by brazing and/or welding the fixing ring to a circumferential surface of the cavity forming at least one arc portion of a welded joint between the fixing ring and the valve body.

7. A method for producing a fuel injection valve for a combustion engine, the method comprising:

shifting a pole piece into a cavity of a valve body having a longitudinal axis;

adjusting an axial position of the pole piece with respect to the valve body;

inserting a fixing ring into the cavity so that the fixing ring abuts the pole piece;

fixing the fixing ring to a circumferential surface of the cavity of the valve body;

inserting a valve needle and an armature mechanically coupled to the valve needle into the cavity so that the valve needle seals a fluid outlet portion of the valve body;

moving the armature in a predetermined direction away from the fluid outlet portion to dispense fluid from the fluid outlet portion after inserting the valve needle and the armature into the cavity and shifting the pole piece into the cavity;

measuring the amount of the dispensed fluid, wherein the adjustment of the axial position of the pole piece with respect to the valve body is carried out in dependence of the measured amount of the dispensed fluid; and inserting the fixing ring into the cavity such that it abuts a side of the pole piece opposite of the armature.

8. The method according to claim 7, further comprising fixing the fixing ring to the valve body by press fit and/or by welding and/or by brazing.

* * * * *